US006311908B1

(12) United States Patent
Kajiyama et al.

(10) Patent No.: US 6,311,908 B1
(45) Date of Patent: Nov. 6, 2001

(54) CRUSHING METHOD FOR WASTE CONTAINING MATERIALS UNFIT FOR CRUSHING AND APPARATUS FOR ITS PRACTICE

(75) Inventors: Takao Kajiyama; Kohei Kawamura; Ryozou Kushida, all of Amagasaki; Hiroshi Arito, Tokyo, all of (JP)

(73) Assignees: Takuma Co., LTD, Osaka; Nihon Spindle Mfg. Co., Ltd., Hyogo, both of (JP)

( * ) Notice: Subject to any disclaimer, the term of this patent is extended or adjusted under 35 U.S.C. 154(b) by 0 days.

(21) Appl. No.: 09/462,750

(22) PCT Filed: May 21, 1999

(86) PCT No.: PCT/JP99/02670

§ 371 Date: Jan. 14, 2000

§ 102(e) Date: Jan. 14, 2000

(87) PCT Pub. No.: WO99/61156

PCT Pub. Date: Dec. 2, 1999

(30) Foreign Application Priority Data

May 22, 1998 (JP) ..... 10-141354

(51) Int. Cl.[7] ..... B02C 18/06

(52) U.S. Cl. ..... 241/29; 241/159; 241/236; 241/260.1

(58) Field of Search ..... 241/29, 236, 159, 241/260.1

(56) References Cited

U.S. PATENT DOCUMENTS 4,752,038 * 6/1988 Takahashi et al. ..... 241/236

FOREIGN PATENT DOCUMENTS 10-128143 5/1998 (JP) .

* cited by examiner

*Primary Examiner*—Mark Rosenbaum
(74) *Attorney, Agent, or Firm*—Wenderoth, Lind & Ponack, L.L.P.

(57) ABSTRACT

The present invention is designed to perform a primary crushing operation including hooking and crushing of the top face part of waste through cooperation of a supporting projection and a first crushing roller. The first crushing roller also conveys the waste. A secondary crushing operation includes crushing of a bottom face part and the top face part of the waste W, while lifting the waste is performed by the first crushing roller and a second crushing roller. And, a tertiary crushing operation including crushing of the object material, that is to be crushed, into small pieces and discharging of these pieces separately from the materials that are unfit for crushing is performed by the second crushing roller and a third crushing roller. The primary crushing operation, secondary crushing operation and tertiary crushing operation are performed one after another, for the purpose of separating and discharging materials that are unfit for crushing without deforming them, and accurately crushing the object material such as frame member, etc., even if the waste is directly submitted to the crushing operations without removing the materials that are unfit for crushing such as a motor, compressor, etc. The recovery ratio of valuables is thus improved upon.

22 Claims, 10 Drawing Sheets

CRUSHING METHOD FOR WASTE CONTAINING MATERIALS UNFIT FOR CRUSHING AND APPARATUS FOR ITS PRACTICE

BACKGROUND OF THE INVENTION

1. Technical Field

The present invention relates to a crushing method for waste containing materials that are unfit for crushing, and an apparatus for its practice. The method is capable of crushing waste such as home electric appliances, etc. discharged as non-inflammable bulky refuse from households, etc., for example, without deforming massive materials that are difficult to crush such as a motor, compressor, etc. contained in the waste, while separating the crushed material from those materials that are unfit for crushing.

2. Background Art

Conventionally, hammer crushers, biaxial crushers, tri-axial crushers, etc. are used for the crushing of waste such as home electric appliances, etc.

In the crushing of waste such as home electric appliances, etc. or refrigerators, for example, the frame material, etc. of the refrigerator can be crushed directly, but massive materials such as the motor and compressor, etc. are difficult to crush.

A manner has therefore been adopted for manually removing such massive materials in advance of crushing, and then crushing of the frame material, etc. by using crushers is performed.

However, a problem with this method is that it requires much manual labor for the removal of the massive materials such as the motors and compressors, etc.

On the other hand, treating a refrigerator with a crusher without removing the motor and compressor presented a problem of extremely low recovery ratio of valuables, because the motor and compressor are deformed as a result of the crushing and become difficult to disassemble after the crushing.

Moreover, a problem with a hammer crusher is that it is dangerous because of the possibility of an explosion, which is liable to result depending on the type of materials mixed in the waste.

In view of these problems inherent in the crushing of waste containing materials that are unfit for crushing, the present inventor et al. proposed a crushing method for waste containing materials that are unfit for crushing and an apparatus for performance of the method. The method and apparatus are capable of separating and discharging materials that are unfit for crushing without deforming them, while crushing object material that is to be crushed, such as a frame member, etc., and thereby improving the recovery ratio of valuables, even in the case where the waste is directly submitted to crushing without removing materials that are unfit for crushing, such as a motor, compressor, etc. in advance of the crushing. (PCT/JP98/04791).

An outline of such a crushing method and apparatus is indicated in FIG. 7 to FIG. 10.

This crusher 50 comprises a first crushing roller 10 on one side under a hopper 2 of a casing 3 that forms the hopper 2 at its top and is open at its bottom. A second crushing roller 11 is positioned at the back of the crushing roller 10, and a third crushing roller 12 faces this second crushing roller 11.

On another side under the hopper 2 is provided a push-in mechanism 13 facing the crushing roller 10, while on a bottom plate 2*a* of the hopper 2 directly under the first crushing roller 10 is provided a supporting projection 14.

Thus, when the waste W containing materials M that are unfit for crushing, such as a motor, compressor, etc. of home electric appliances, are injected in the hopper 2, these materials are pushed by the push-in mechanism 13, toward the first crushing roller 10. Then, to prevent free move of the waste W, the waste W is supported by the supporting projection 14, and the first crushing roller 10 bites into the waste W, thereby accurately crushing the waste W while conveying it.

The first crushing roller 10 is constructed, as shown in FIG. 8, by attaching a large number of crushing blades 21 at coarse intervals "a" on a rotary shaft 20 such that the crushing blades 21 project from the rotary shaft 20.

These crushing blades 21 are formed with a height "b", which allows them to easily bite into the waste W while the materials M that are unfit for crushing contained in the waste W are received within the gaps between the crushing blades 21, and then pass through these gaps without being crushed by the first crushing roller 10. Preferably, the tips of the crushing blades 21 are oriented at an acute angle so that the tips may easily bite into the waste W.

Furthermore, the casing 3 directly above the first crushing roller 10 is provided with a stationary knife 22 to be inserted in the gaps between the crushing blades 21 of the first crushing roller 10, so as to scrape from the crushing blades 21 the crushed material which sticks to the crushing blades 21.

The second crushing roller 11 is realized by attaching screw blades 25 onto a rotary shaft 24, as shown in FIG. 9, and these screw blades 25 are designed to have a coarse pitch and a height enabling the materials M that are unfit for crushing to be received within the gaps between the screw blades 25 and pass therethrough without being crushed, while crushing object materials that are to be crushed, such as frame member, etc., as the second crushing roller operates in combination with the third crushing roller 12.

A screw blade 25 is constructed from screw blades 25*a* and 25*b*, which are twisted in directions opposite to each other and formed by splitting a single screw into two pieces. The screw blades 25*a* and 25*b* are to prevent the object material that is to be crushed from moving sideways at the time of crushing.

The third crushing roller 12 is realized by attaching, as shown in FIG. 10, main screw blades 27 and auxiliary screw blades to a rotary shaft 26. The auxiliary screw blades 28 have a coarser pitch as compared with that of the main screw blades 27, and are twisted in the direction opposite to the main screw blades 27, such that grids "g" are formed between the main screw blades 27 and the auxiliary screw blades 28. The main screw blades 27 and auxiliary screw blades 28 have a height that enables the materials M that are unfit for crushing to be received within these gaps or grids "g" and pass therethrough without being crushed.

The main screw blades 27 and the auxiliary screw blades 28 are constructed from screw blades 27*a*, 27*b*, 28*a*, 28*b*, which are twisted in directions opposite to each other and formed by splitting respective screws into two pieces each. The opposite directions of twist are to prevent the object material that is to be crushed from moving sideways at the time of crushing.

And, on the discharge side of the casing 3 is provided a conveyor 16.

This conveyor 16, installed at a required inclination, is designed to make the materials M that are unfit for crushing, in massive state without being crushed, tumble from the conveyor 16 after being discharged on the conveyor 16. The conveyor 16 is also designed to move the crushed and flattened object material upward when discharged on the conveyor 16, without rolling or sliding of the crushed and flattened object material, so as to discharge the crushed and flattened object material while automatically separating the crushed and flattened material from the materials that are unfit for crushing. This conveyor 16 is constructed in such a way that its inclination may be adjustable as desired.

According to this crusher of waste, although it is possible to achieve a certain objective of separating and discharging materials that are unfit for crushing without deforming them, the waste W supplied by the hopper 2 and pushed by the push-in mechanism 13 to the side of the first crushing roller 10 has its top face part crushed by the first crushing roller 10 while its bottom face part is conveyed toward the second crushing roller 11 and the third crushing roller 12 along a discharge guide chute 17 together with the materials M that are unfit for crushing in an uncrushed state.

For that reason, the crushing of the bottom face part of the waste W and the separation of the materials M that are unfit for crushing must be performed at the same time by the second crushing roller 11 and the third crushing roller 12, which face each other, thereby presenting a problem of difficulty of separation in some cases.

SUMMARY OF THE INVENTION

The objective of the present invention, realized in view of the problems with the crushing of waste containing materials that are unfit for crushing, is to provide a crushing method for waste containing materials that are unfit for crushing and an apparatus for its practice which method and apparatus are capable of separating and discharging the materials that are unfit for crushing without deforming them, while crushing object material that is wanted to be crushed, such as frame members, etc. This allows for improvement in the recovery ratio of valuables, even in cases where the waste is directly submitted to crushing without the advanced removal of materials that are unfit for crushing, such as motors, compressors, etc.

To achieve this objective, the crushing method for waste containing materials that are unfit for crushing according to the present invention is characterized in that it includes a primary crushing operation performed with a crushing roller that conveys the waste by hooking a top face part of the waste, while allowing passage of materials that are unfit for crushing, and contained in the waste, without crushing these materials. The method further includes a secondary crushing operation performed with a crushing rollers that crush both the top and bottom faces of the waste and, in the same way as in the primary crushing, allows the passage of materials that are unfit for crushing, and contained in the waste, without crushing these materials. The method also includes a tertiary crushing of the object material, that is to be crushed, into small pieces, and separately discharging these pieces from the materials that are unfit for crushing.

The crushing method for waste containing materials that are unfit for crushing according to the present invention is capable of accurately crushing only the object material through the primary, secondary and tertiary crushings, by allowing any materials that are unfit for crushing, and contained in the waste, to pass without crushing these materials that are unfit for crushing, during the primary, secondary and tertiary crushings. Moreover, it is also capable of easily separating materials that are unfit for crushing by accurately crushing the top face part of the waste during the primary crushing, and crushing both the top and bottom face parts of the waste during the secondary crushing, thereby remarkably improving the recovery ratio of valuables.

Moreover, the crushing apparatus implementing the crushing method for waste containing materials that are unfit for crushing according to the present invention is a crushing apparatus for waste containing materials that are unfit for crushing, which includes supporting projections for supporting the waste supplied, and a first crushing roller for hooking and crushing the top face part of the waste supported by the supporting projections, while also conveying the waste. The crushing apparatus also includes a second crushing roller disposed at the back of the first crushing roller, and a third crushing roller for performing crushing in combination with the second crushing roller. The first crushing roller is constructed by attaching a large number of crushing blades, for biting, on a rotary shaft with gaps between the crushing blades, thereby allowing for the passage of materials that are unfit for crushing and contained in the waste. Cooperation of the second crushing roller, which is provided with a screw-shaped crushing blade, and the first crushing roller performs crushing of both the top and bottom face parts of the waste while conveying the waste. And, crushing the object material into small pieces and separately discharging these pieces from the materials that are unfit for crushing is performed by cooperation of the third crushing roller and the second crushing roller.

This crushing apparatus for waste containing materials that are unfit for crushing according to the present invention is capable of performing a primary crushing by hooking and crushing the top face part of the waste while conveying the waste, by virtue of the supporting projections and the first crushing roller. The apparatus is also capable of performing a secondary crushing of both the top and bottom face parts of the waste while conveying the waste by virtue of the first crushing roller and the second crushing roller. And, the apparatus is further capable of performing a tertiary crushing of the object material, to be crushed, such that this object material is crushed into small pieces and separately discharged from the materials that are unfit for crushing, by virtue of the second crushing roller and the third crushing roller. In addition, the apparatus is also capable of easily separating materials that are unfit for crushing by accurately crushing the top face part of the waste during the primary crushing, and crushing both the top and bottom face parts of the waste during the secondary crushing, thereby remarkably improving the recovery ratio of valuables.

The second crushing roller can include crushing blades, for biting, attached to the rotary shaft with gaps between these crushing blades for allowing the passage of materials that are unfit for crushing and contained in the waste. These crushing blades protrude from the screw blade, so as to make these crushing blades bite in combination with the crushing blades of the first crushing roller, thereby making it possible to allow materials that are unfit for crushing to pass without crushing these materials, and effectively perform the crushing of the waste by cooperation of the crushing blades of the first crushing roller and those of the second crushing roller.

Furthermore, a stationary knife can be attached to the casing facing the second crushing roller, in such a way that the knife engages with the crushing blades of the second crushing roller, so as to crush the object material between these crushing blades and the stationary knife, thereby making it possible to effectively crush waste with a combination of the crushing blades of the second crushing roller and the stationary knife.

Additionally, the third crushing roller can be constructed in a way to include main screw blades and auxiliary screw blades, wherein the auxiliary screw blades have a coarse pitch and are oriented in a direction that is opposite to that of the main screw blades such that grids are formed between the auxiliary screw blades and the main screw blades. The respective screw blades are formed with a pitch allowing for the passage of the materials that are unfit for crushing, thereby making it possible to allow the materials that are unfit for crushing to pass without being crushed, and accurately crush the object material by virtue of the feed action of the third crushing roller in combination with the second crushing roller.

Still further, the third crushing roller can include a plurality of segments that are parallel to the rotary shaft and project perpendicularly from the circumferential face thereof, thereby making it possible to accurately separate the crushed object material from the materials that are unfit for crushing without being crushed together, while reducing the manufacturing cost of the third crushing roller.

In addition, it is possible to form, in these segments, notches for allowing the passage of the crushing blade of the second crushing roller, thereby making it possible for the crushing blade of the second crushing roller to accurately separate power cords, etc. that are connected to the materials that are unfit for crushing in such a way that the crushing blade of the second crushing roller snatches the power cords, etc. when passing through the notches in the segments.

DESCRIPTION OF THE PREFERRED EMBODIMENTS

Figure 1:
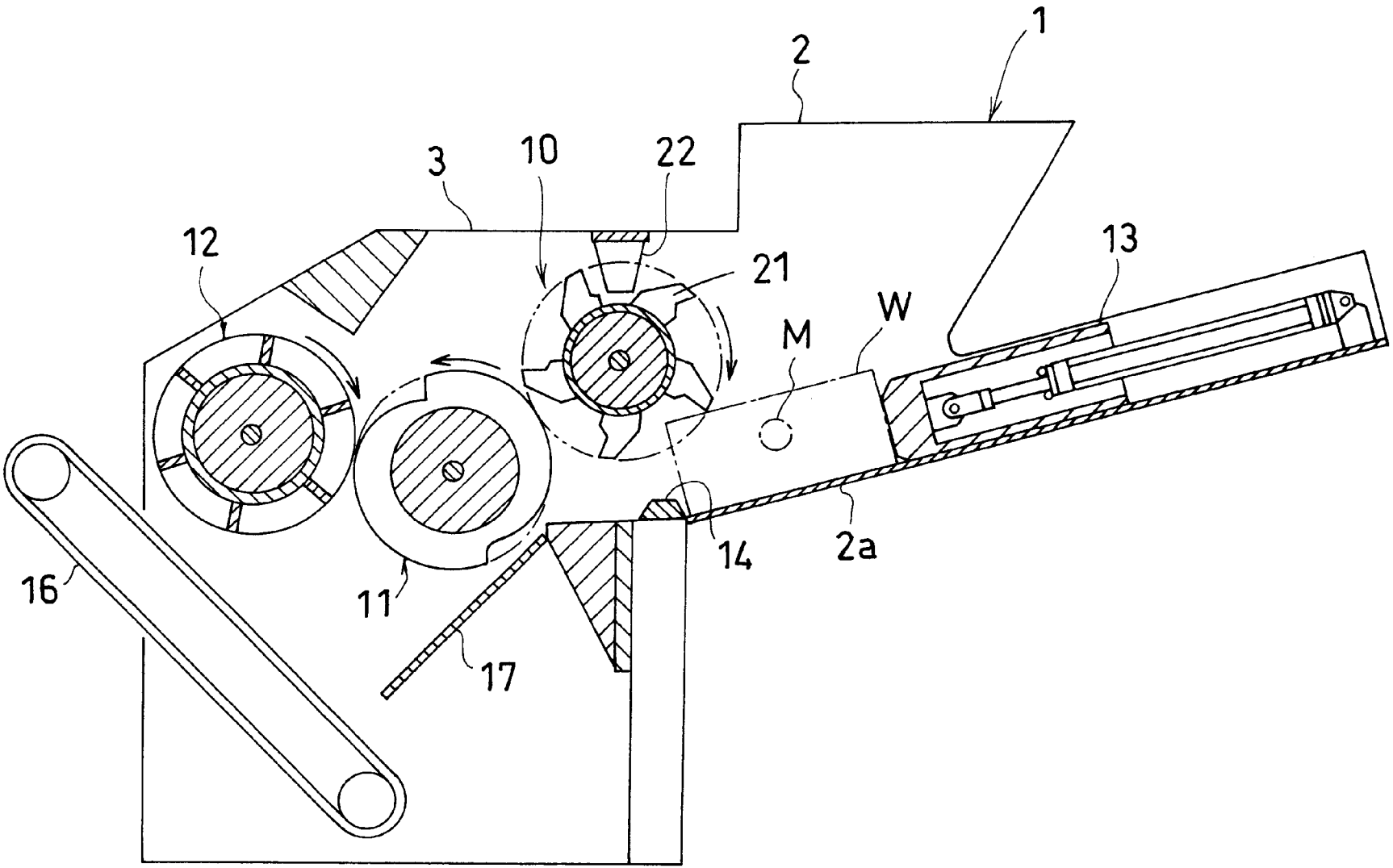
FIG. 1 is a sectional view showing a first embodiment of the crushing apparatus for waste containing materials that are unfit for crushing according to the present invention.

The present invention will be described hereafter based on the embodiments indicated in the drawings.

FIG. 1 indicates a first embodiment of the crushing apparatus for waste containing materials that are unfit for crushing, according to the present invention.

This crusher 1 comprises a first crushing roller 10 positioned on one side under a hopper 2 of a casing 3. The casing 3 is open at its top and bottom, and the hopper 2 is formed at the open top. A second crushing roller 11 is positioned at the back of the first crushing roller 10, and a third crushing roller 12 faces the second crushing roller 11.

On the other side under the hopper 2 is provided a push-in mechanism 13 facing the first crushing roller 10, while on a bottom plate 2*a* of the hopper 2, directly under the first crushing roller 10 is provided a supporting projection 14.

When waste W containing materials or components that are unfit for crushing, such as a motor, compressor, etc. of home electric appliances, is injected in the hopper 2 the push-in mechanism 13 pushes the waste W toward the first crushing roller 10. The first crushing roller 10 engages or hooks the waste W and crushes crushable components in the top face part thereof. The waste W is then conveyed further into the casing 3, while preventing free move of the waste W by supporting the waste W with the supporting projection 14. This corresponds to a primary crushing of the waste W.

Figure 7:
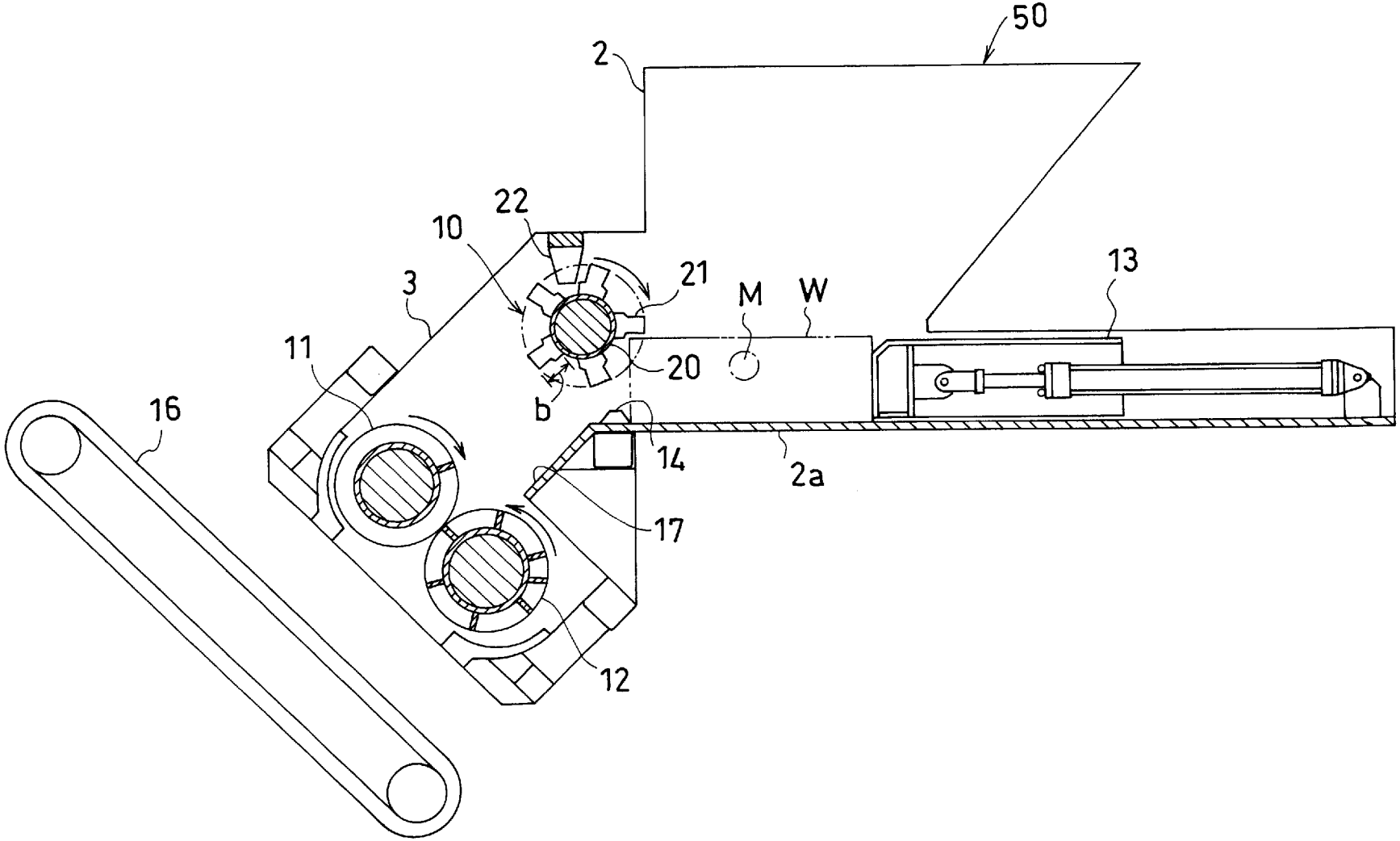
FIG. 7 is a sectional view showing another crushing apparatus for waste containing materials that are unfit for crushing.
Figure 8:
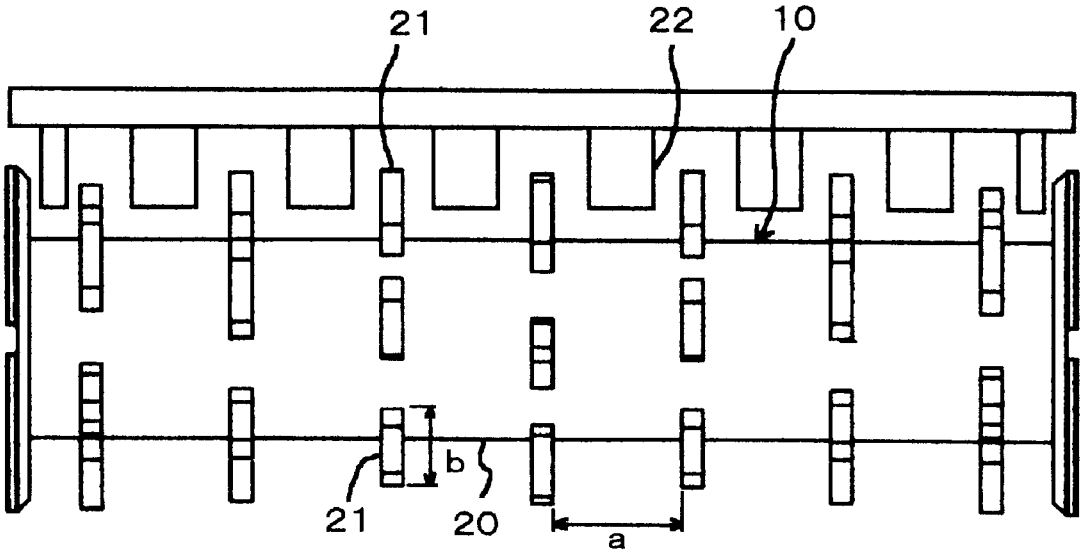
FIG. 8 is a front elevational view of the first crushing roller of the another crushing apparatus.
Figure 9:
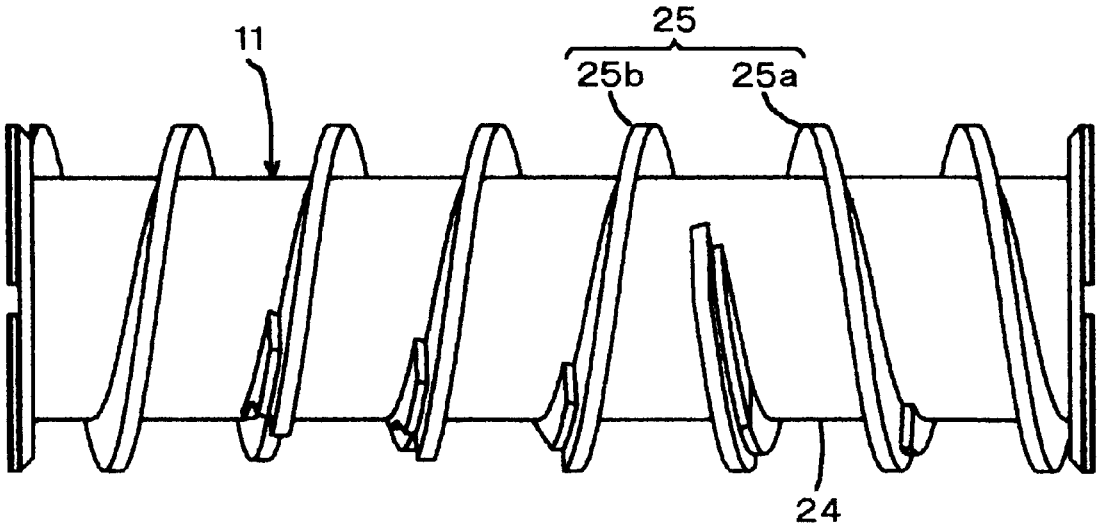
FIG. 9 is a front elevational view of the second crushing roller of the another crushing apparatus.
Figure 10:
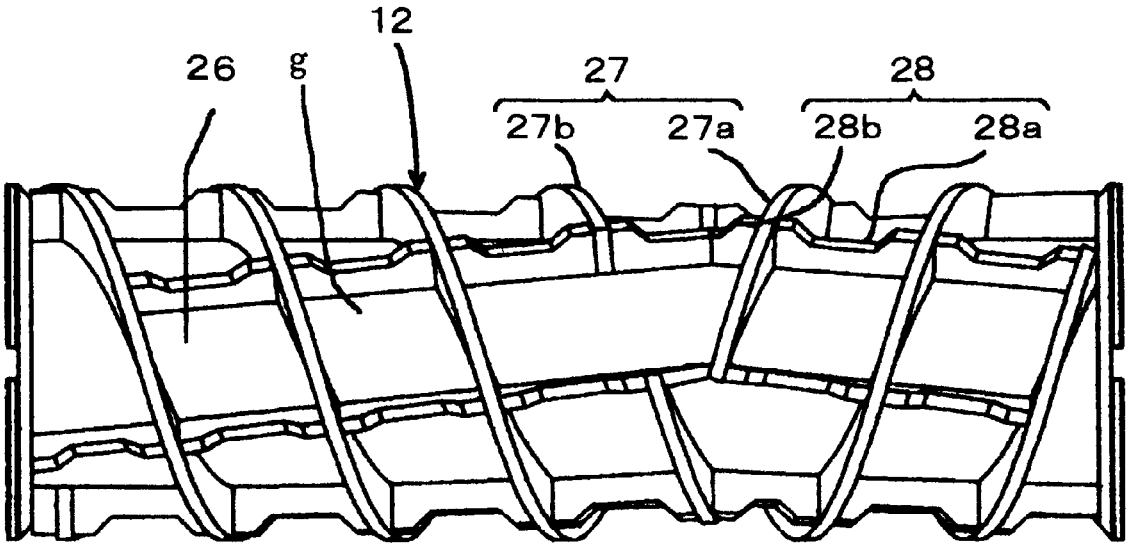
FIG. 10 is a front elevational view of the third crushing roller of the another crushing apparatus.

The first crushing roller 10 is constructed by attaching a large number of crushing blades 21 at coarse intervals on a rotary shaft, such that the crushing blades 21 project from the rotary shaft. The construction and action of this first crushing roller 10, a stationary knife 22 to be inserted in a gap between the crushing blades 21, and the casing 3 directly above the first crushing roller 10 are the same, unless otherwise mentioned, to those of the crushing apparatus 50 indicated in FIG. 7.

In the crusher 1 of this embodiment, the second crushing roller 11 is provided with a screw-shaped crushing blade and is disposed at the back of, and in proximity to, the first crushing roller 10, at a position slightly higher than the supporting projection 14. This enables crushable components in the bottom face part and top face part of the waste W to be jointly crushed by the first crushing roller 10 and the second crushing roller 11, while lifting the waste W from the bottom plate 2*a* of the hopper 2. This corresponds to a secondary crushing of the waste W.

The directions of rotation and drive of the first crushing roller 10 and the second crushing roller 11 are opposite to each other.

A third crushing roller 12 is disposed in a horizontal position at the back of, and in proximity to, the second crushing roller 11. The crushable components of the waste W passed between the first crushing roller 10 and the second crushing roller 11 are jointly crushed by the second crushing roller 11 and the third crushing roller 12. This corresponds to a tertiary crushing of the waste W.

The directions of rotation and drive of the second crushing roller 11 and the third crushing roller 12 are opposite to each other.

Below the second crushing roller 1I1 and the third crushing roller 12 are provided a conveyor 16 and a discharge guide chute 17 at required inclinations, respectively. Materials M that are unfit for crushing, and have not been crushed, fall on the conveyor 16 and then tumble therefrom because of their shape and weight. On the other hand, finely crushed and flattened material moves upward on the conveyor 16 without tumbling or sliding, so as to be discharged therefrom. This automatically separates the crushed and flattened material from that which has not been crushed or flattened. The conveyor 16 is constructed in such a way that its inclination may be adjustable as desired.

The crusher 1 constructed as described above performs the primary crushing through cooperation of the supporting projection 14 and the first crushing roller 10. The primary crushing includes conveyance of the waste W while it is being crushed, by engaging or hooking the top face part of the waste W with the first crushing roller 10, while allowing passage of materials M that are unfit for crushing, and contained in the waste, without being crushed. The secondary crushing performed by the first crushing roller 10 and the second crushing roller 11, includes crushing of the bottom face part and the top face part of the waste W while lifting the waste W. And, the tertiary crushing performed by the second crushing roller 11 and the third crushing roller 12, includes crushing the material to be crushed into small pieces and then discharging these pieces separately from the materials M that are unfit for crushing. The primary, secondary and tertiary crushing are performed one after another, thus making it possible to let pass any materials M that are unfit for crushing, which may exist in the waste W supplied, without crushing these materials M, and accurately crush only the object material to be crushed.

The crusher 1 is capable of accurately crushing the top face part of the waste W via the primary crushing, through cooperation of the supporting projection 14 and the first crushing roller 10, is capable of crushing the bottom face part and the top face part of the waste W via the secondary crushing through cooperation of the first crushing roller 10 and the second crushing roller 11, and is capable of easily separating materials M that are unfit for crushing from the waste W via the subsequent tertiary crushing through cooperation of the second crushing roller 11 and the third crushing roller 12. These capabilities of the crusher 1 remarkably improve the recovery ratio of valuables.

Figure 2:
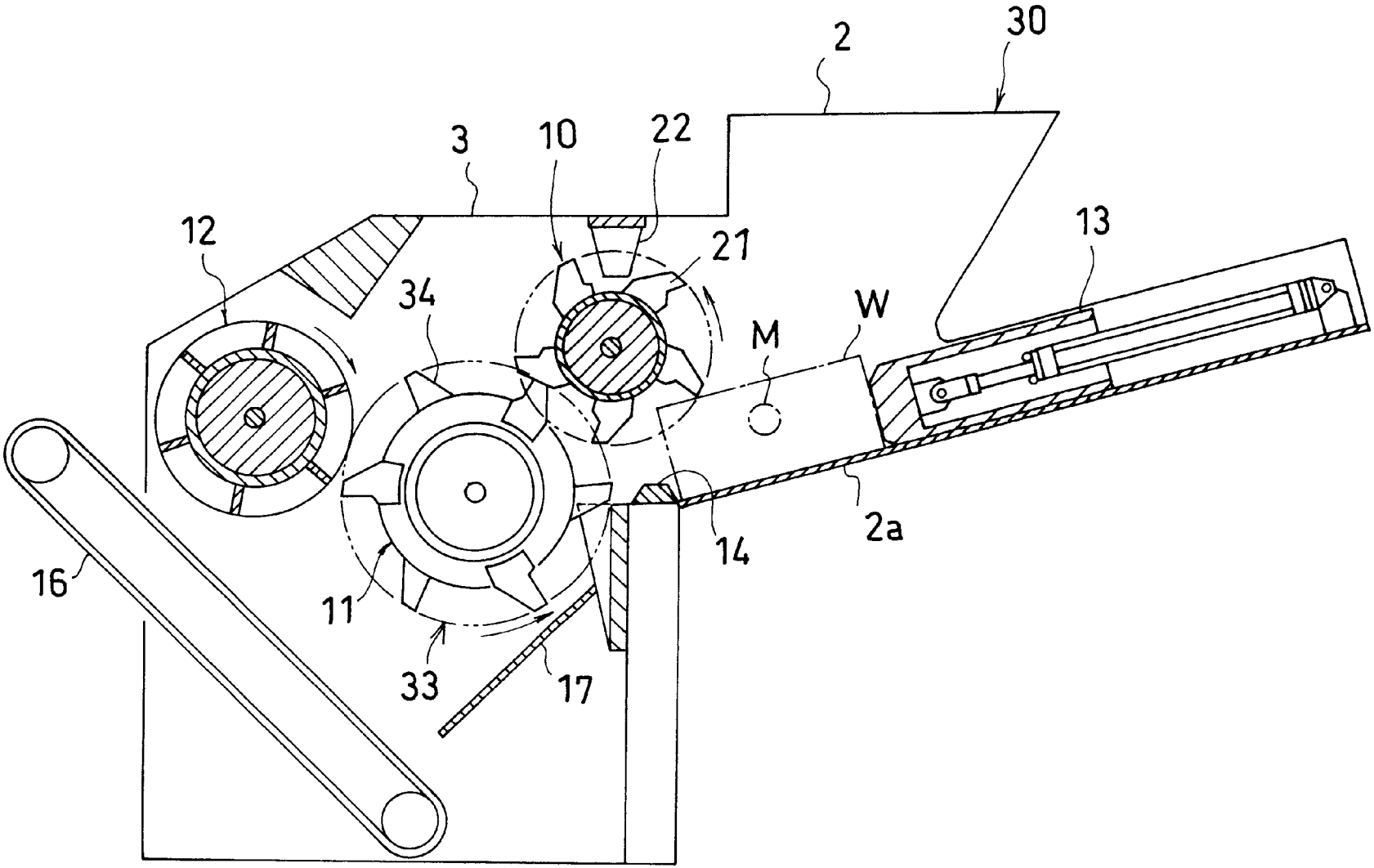
FIG. 2 is a sectional view showing a second embodiment of the crushing apparatus for waste containing materials that are unfit for crushing according to the present invention.
Figure 3:
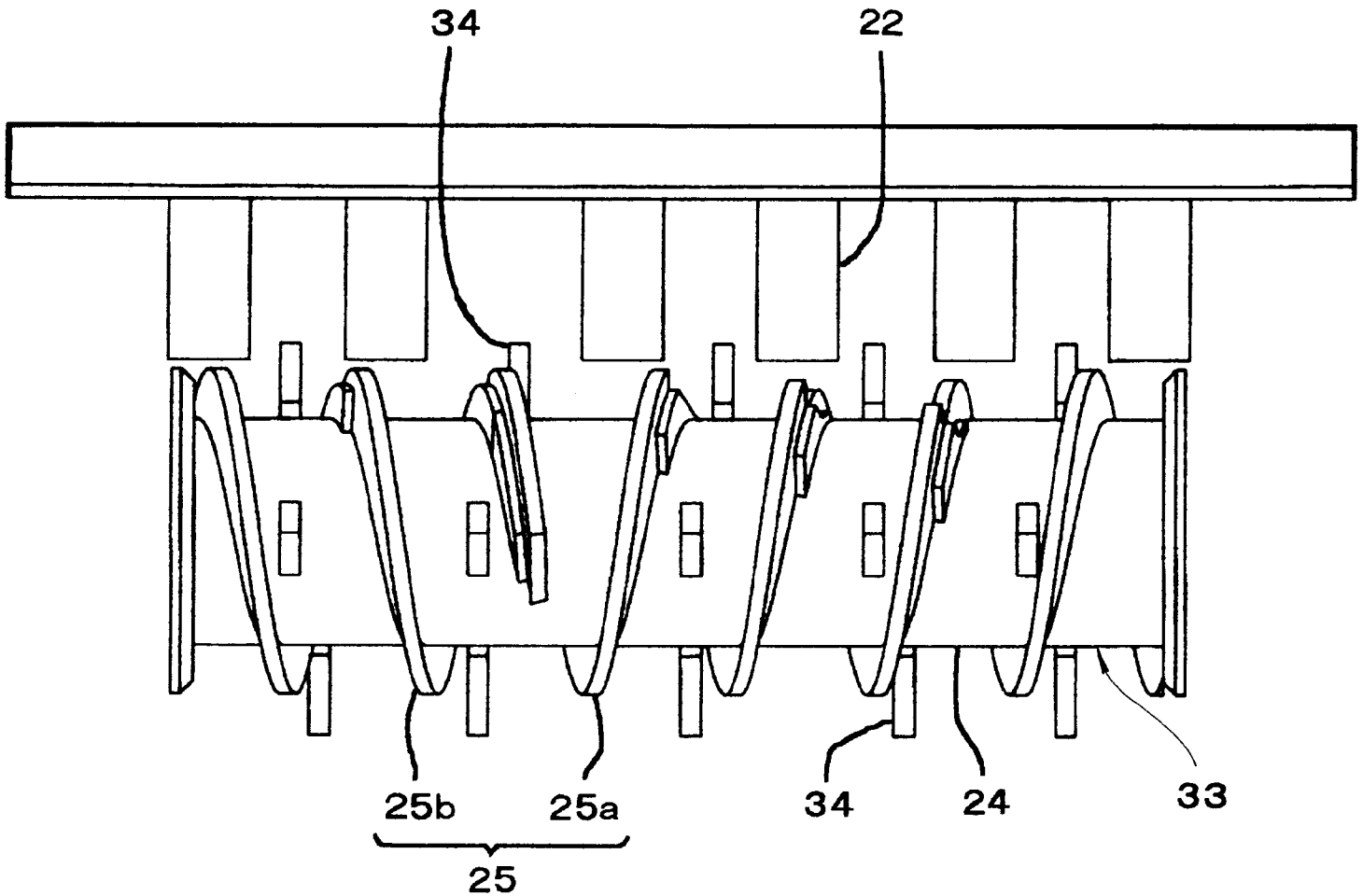
FIG. 3 is a front elevational view of the second crushing roller of the second embodiment.

FIG. 2 and FIG. 3 indicate the second embodiment of the crusher according to the present invention.

In this crusher 30 a second crushing roller 33 provided with crushing blades 34 is used in place of the second crushing roller 11 of the crusher 1 of the first embodiment.

The crushing blades 34 of the second crushing roller 33 are attached to a rotary shaft 24 by welding, etc. in a way to protrude beyond a screw blade 25, as shown in FIG. 3, and is constructed in such a way such that these crushing blades 34 operate like the crushing blades 21 of the first crushing roller 10.

This makes it possible to let pass materials M that are unfit for crushing without crushing them, while effectively performing crushing of the waste W, with the crushing blades 21, 34 of the first crushing roller 10 and the second crushing roller 33 respectively reaching necessary depths of the waste W.

Other constructions and actions of this embodiment are the same as those of the crusher 1 of the first embodiment.

Figure 4:
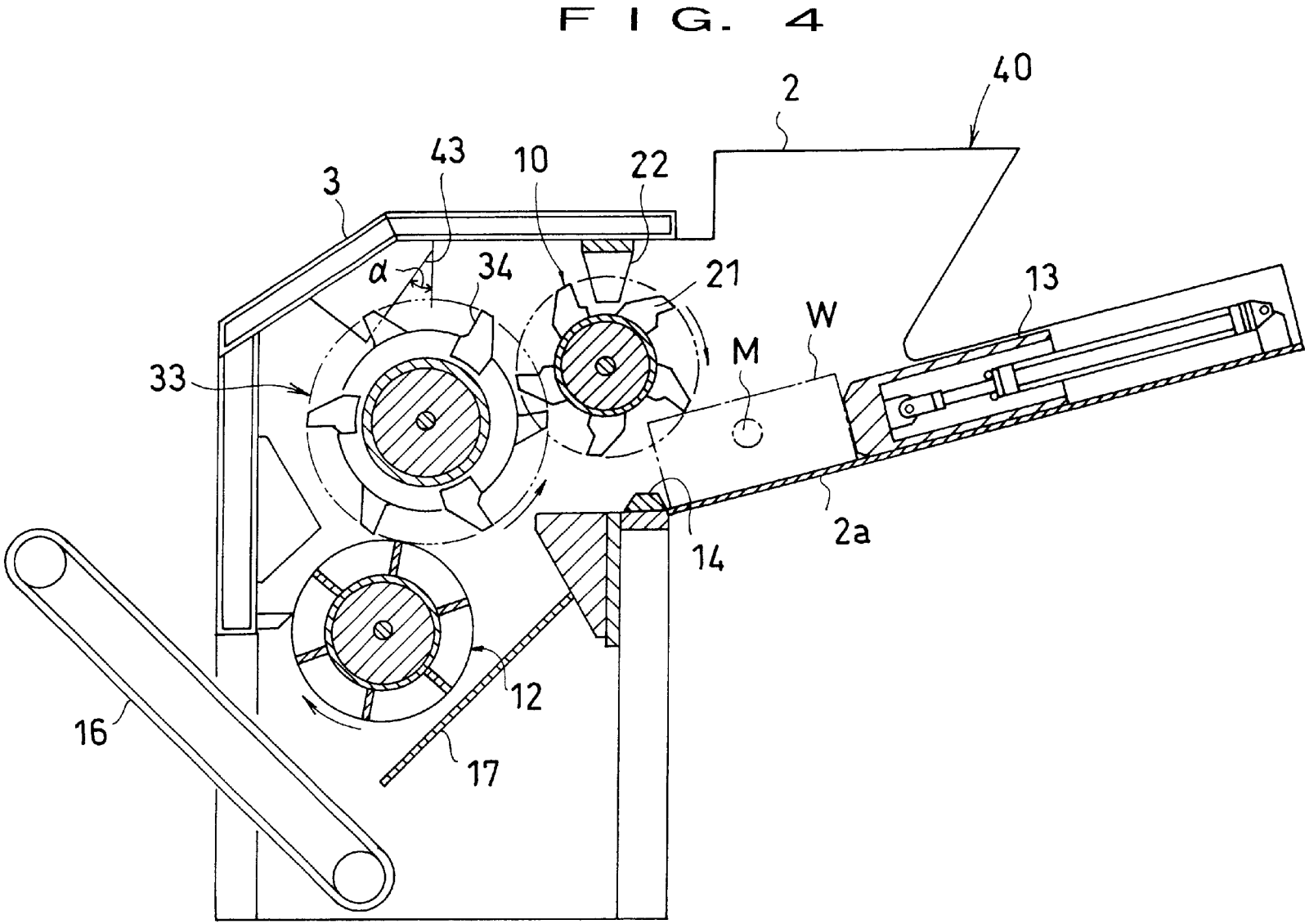
FIG. 4 is a sectional view showing a third embodiment of the crushing apparatus for waste containing materials that are unfit for crushing according to the present invention.

FIG. 4 indicates a third embodiment of the crusher according to the present invention.

In this crusher 40 a second crushing roller 33 provided with crushing blades 34 is used in place of the second crushing roller 11 of the crusher 1 of the first embodiment, in the same manner as with the crusher 30 of the second embodiment. Also, a stationary knife 43 is attached to the casing 3 in such a way as to engage with the crushing blades 34 of the second crushing roller 33.

The stationary knife 43 is preferably attached with an inclination a so that it may be easily received within the screw blade 25 of the crushing roller 33 when engaging materials M that are unfit for crushing.

This makes it possible to let pass materials M that are unfit for crushing without crushing them, while effectively performing crushing of the waste W, with the crushing blades 21, 34 of the first crushing roller 10 and the second crushing roller 33 respectively reaching necessary depths of the waste W, and also while performing the crushing of the waste W more effectively via a combination of the crushing blades 34 and the stationary knife 43.

Other constructions and actions of this embodiment are the same as those of the crusher 1 in the first embodiment.

Figure 5:
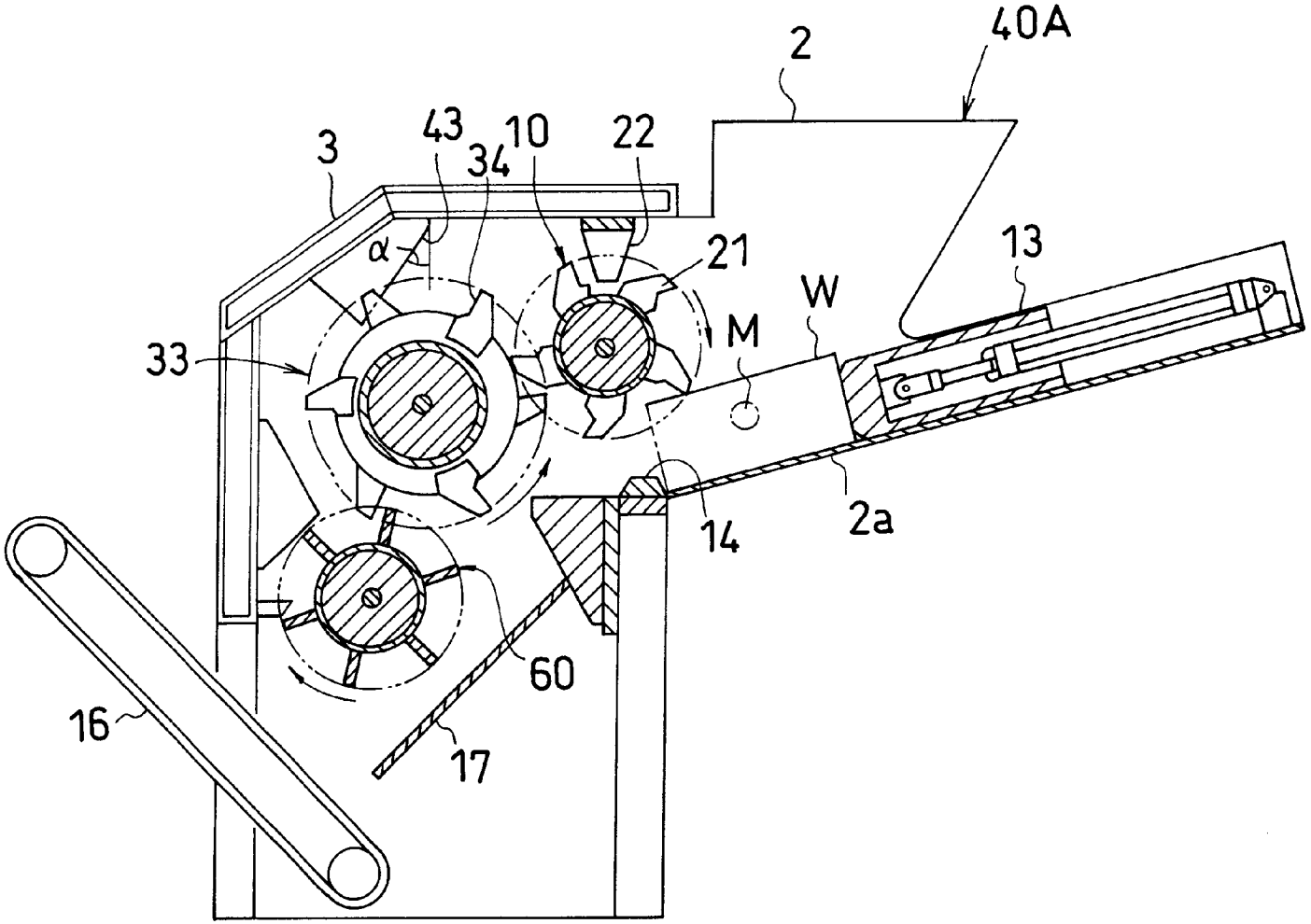
FIG. 5 is a sectional view showing a fourth embodiment of the crushing apparatus for waste containing materials that are unfit for crushing according to the present invention.
Figure 6:
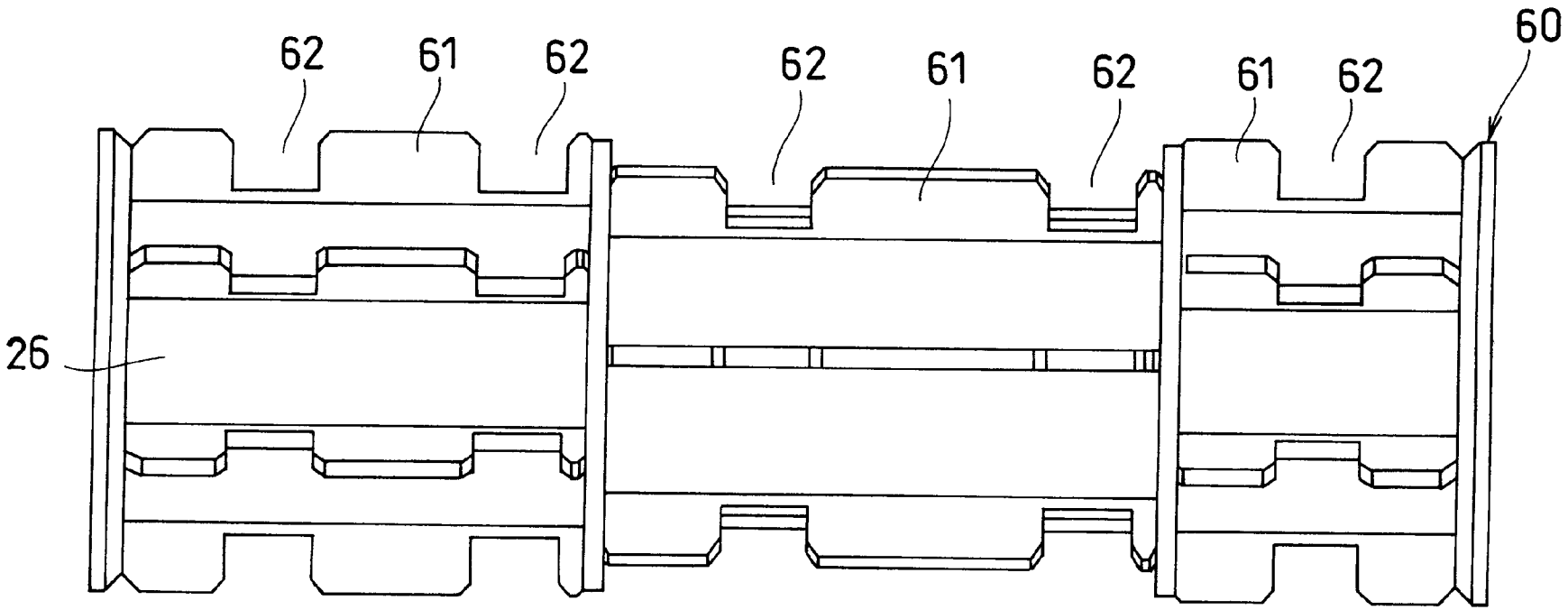
FIG. 6 is a front elevational view of the third crushing roller of the fourth embodiment.

FIG. 5 and FIG. 6 indicate a fourth embodiment of the crusher according to the present invention.

In this crusher 40A a second crushing roller 33 provided with crushing blades 34 is used in place of the second crushing roller 11 of the crusher 1 of the first embodiment, in the same manner as with the crusher 30 of the third embodiment. Also, a stationary knife 43 is attached to the casing 3 in such a way as to engage with the crushing blades 34 of the second crushing roller 33.

This makes it possible to let pass materials M that are unfit for crushing without crushing them, while effectively performing crushing of the waste W, with the crushing blades 21, 34 of the first crushing roller 10 and the second crushing roller 11 respectively reaching necessary depths of the waste W, and also while performing the crushing of the waste W more effectively via a combination of the crushing blades 34 and the stationary knife 43.

Furthermore, in this crusher 40A a third crushing roller 60 is used in place of the third crushing roller 12 of the crusher 1 of the first embodiment.

This third crushing roller 60 is constructed, as shown in FIG. 6, from a plurality (six pieces each in three parts divided in the axial direction of rotary shaft 26, though not particularly so restricted) of segments 61 in parallel with the rotary shaft 26 and projecting perpendicularly from the circumferential face thereof. Notches 62 are formed in the segments for allowing passage of the crushing blades 34 of the second crushing roller 33.

The notches 62 may be omitted in the case where the third crushing roller 60 is not made to engage with the second crushing roller 33.

This makes it possible to accurately separate the material to be crushed from the materials M that are unfit for crushing and are not crushed, while reducing the manufacturing cost of the third crushing roller 60. This also makes it possible for the crushing blades 34 of the second crushing roller 33 to accurately separate a power cord, etc. that is connected to the materials M that are unfit for crushing in such a way as to snatch it when passing through the notches 62 in the segments 61.

Other constructions and actions of this embodiment are the same as those of the crusher 1 of the first embodiment.

Possibility of Industrial Application

With the crushing method for waste containing materials that are unfit for crushing, and the apparatus for its practice, according to the present invention, it is possible to separate and discharge materials that are unfit for crushing without deforming them, while crushing the materials that are to be crushed such as a frame member, etc., and efficiently perform crushing of waste containing materials that are unfit for crushing such as home electric appliances, etc. while maintaining a high recovery ratio of valuables, even in the case where the waste is directly submitted to crushing without first removing materials that are unfit for crushing such as a motor, compressor, etc.

What is claimed is:

1. A method for crushing material that includes crushable components and other components that are unfit for crushing, comprising:

subjecting material including crushable components and other components that are unfit for crushing to a first crushing operation, whereby a primary crushing roller engages a top portion of said material such that said material is conveyed while said crushable components are crushed and said other components are not crushed;

subjecting said material including said crushable components and said other components that are unfit for crushing to a second crushing operation, whereby secondary crushing rollers engage the top portion and a bottom portion of said material, respectively, such that said crushable components are further crushed while said other components are not crushed; and subjecting said material including said crushable components and said other components that are unfit for crushing to a third crushing operation, whereby said crushable components are further crushed into pieces and said other components are separated from said pieces.

2. The method according to claim 1, wherein subjecting said material to a third crushing operation includes subjecting said material to tertiary crushing rollers without crushing of said other components, with one of said secondary crushing rollers being employed as one of said tertiary crushing rollers.

3. The method according to claim 2, wherein subjecting said material to a second crushing operation includes employing said primary crushing roller as one of said secondary crushing rollers but not as said one of said tertiary crushing rollers.

4. The method according to claim 1, wherein subjecting said material to a second crushing operation includes employing said primary crushing roller as one of said secondary crushing rollers.

5. A crushing apparatus for crushing material that includes crushable components and other components that are unfit for crushing, comprising:

a first crushing roller including spaced crushing blades projecting from a rotary shaft, with said spaced crushing blades for engaging a top portion of material and conveying the material, and also for crushing crushable components of the material, and with said spaced crushing blades being spaced such that gaps between adjacent blades allow for passage of other components of the material that are unfit for crushing;

a second crushing roller positioned downstream of said first crushing roller, with said second crushing roller including a screw-shaped crushing blade for engaging a bottom portion of the material and cooperating with said spaced cutting blades of said first crushing roller to further crush the crushable components while conveying the material; and a third crushing roller for cooperating with said screw-shaped crushing blade of said second crushing roller to crush the crushable components into pieces and separate the pieces from the other components of the material that are unfit for crushing.

6. The crushing apparatus according to claim 5, further comprising a projection for supporting material supplied thereto, wherein said spaced crushing blades are for engaging a top portion of the material and conveying the material as the material is supported by said projection, and are also for crushing crushable components of the material as the material is supported by said projection.

7. The crushing apparatus according to claim 6, wherein said second crushing roller includes additional spaced crushing blades attached to a rotary shaft and extending beyond said screw-shaped blade, with said additional spaced cutting blades being spaced such that gaps between adjacent blades allow for passage of the other components of the material that are unfit for crushing, and with said additional spaced crushing blades for cooperating with said spaced crushing blades of said first crushing roller.

8. The crushing apparatus according to claim 7, wherein said third crushing roller includes segments extending from a rotary shaft, with said segments being substantially parallel to an axis of rotation of said rotary shaft.

9. The crushing apparatus according to claim 8, wherein said segments include notches for allowing passage therethrough of said screw-shaped crushing blade.

10. The crushing apparatus according to claim 7, further comprising a stationary knife facing said second crushing roller.

11. The crushing apparatus according to claim 10, wherein said third crushing roller includes segments extending from a rotary shaft, with said segments being substantially parallel to an axis of rotation of said rotary shaft.

12. The crushing apparatus according to claim 11, wherein said segments include notches for allowing passage therethrough of said screw-shaped crushing blade.

13. The crushing apparatus according to claim 10, wherein said third crushing roller includes a main screw blade and an auxiliary screw blade, with said main screw blade extending in a first direction and having a first pitch, and said auxiliary screw blade extending in a second direction that is opposite to said first direction and having a coarse pitch, such that grids are formed between said main screw blade and said auxiliary screw blade, and wherein the first pitch and the coarse pitch allow for the other components of the material that are unfit for crushing to pass between turns of said main screw blade and said auxiliary screw blade.

14. The crushing apparatus according to claim 13, wherein said third crushing roller includes segments extending from a rotary shaft, with said segments being substantially parallel to an axis of rotation of said rotary shaft.

15. The crushing apparatus according to claim 14, wherein said segments include notches for allowing passage therethrough of said screw-shaped crushing blade.

16. The crushing apparatus according to claim 7, wherein said third crushing roller includes a main screw blade and an auxiliary screw blade, with said main screw blade extending in a first direction and having a first pitch, and said auxiliary screw blade extending in a second direction that is opposite to said first direction and having a coarse pitch, such that grids are formed between said main screw blade and said auxiliary screw blade, and wherein the first pitch and the coarse pitch allow for the other components of the material that are unfit for crushing to pass between turns of said main screw blade and said auxiliary screw blade.

17. The crushing apparatus according to claim 6, wherein said third crushing roller includes segments extending from a rotary shaft, with said segments being substantially parallel to an axis of rotation of said rotary shaft.

18. The crushing apparatus according to claim 17, wherein said segments include notches for allowing passage therethrough of said screw-shaped crushing blade.

19. The crushing apparatus according to claim 18, wherein said third crushing roller includes a main screw blade and an auxiliary screw blade, with said main screw blade extending in a first direction and having a first pitch, and said auxiliary screw blade extending in a second direction that is opposite to said first direction and having a coarse pitch, such that grids are formed between said main screw blade and said auxiliary screw blade, and wherein the first pitch and the coarse pitch allow for the other components of the material that are unfit for crushing to pass between turns of said main screw blade and said auxiliary screw blade.

20. The crushing apparatus according to claim 6, wherein said third crushing roller includes a main screw blade and an auxiliary screw blade, with said main screw blade extending in a first direction and having a first pitch, and said auxiliary screw blade extending in a second direction that is opposite to said first direction and having a coarse pitch, such that grids are formed between said main screw blade and said auxiliary screw blade, and wherein the first pitch and the coarse pitch allow for the other components of the material that are unfit for crushing to pass between turns of said main screw blade and said auxiliary screw blade.

21. The crushing apparatus according to claim 20, wherein said third crushing roller includes segments extending from a rotary shaft, with said segments being substantially parallel to an axis of rotation of said rotary shaft.

22. The crushing apparatus according to claim 6, further comprising a stationary knife facing said second crushing roller.

* * * * *